US011608631B2

(12) United States Patent
Munden et al.

(10) Patent No.: US 11,608,631 B2
(45) Date of Patent: Mar. 21, 2023

(54) METHOD AND APPARATUS FOR PROTECTING BUILDING-RELATED ELEMENTS FROM COLLISION DAMAGES

(71) Applicant: Guard Pro LLC, Clifton, TX (US)

(72) Inventors: Kade C. Munden, Clifton, TX (US); Bruce W. Null, Highland Village, TX (US)

(73) Assignee: Guard Pro LLC, Clifton, TX (US)

( * ) Notice: Subject to any disclaimer, the term of this patent is extended or adjusted under 35 U.S.C. 154(b) by 179 days.

(21) Appl. No.: 16/849,743

(22) Filed: Apr. 15, 2020

(65) Prior Publication Data

US 2021/0324625 A1 Oct. 21, 2021

(51) Int. Cl.
*E04F 19/02* (2006.01)
*E04B 1/98* (2006.01)

(52) U.S. Cl.
CPC ..... *E04B 1/98* (2013.01); *E04F 19/02* (2013.01); *E04F 19/028* (2013.01); *E04F 2203/02* (2013.01); *E04F 2290/02* (2013.01); *E04F 2290/044* (2013.01)

(58) Field of Classification Search
CPC ..... E04B 1/98; E04F 19/02; E04F 2203/02; E04F 2290/02; E04F 2290/044; E04F 1/18; E04H 17/14
See application file for complete search history.

(56) References Cited

U.S. PATENT DOCUMENTS 996,421 A * 6/1911 McCausland ..... 248/101
2,079,582 A * 5/1937 Whipple ..... A62B 18/025 128/206.24
3,258,250 A * 6/1966 McMullin ..... F16B 7/0493 256/13.1
3,589,682 A * 6/1971 Dickey ..... E04G 25/06 256/59
4,383,676 A * 5/1983 Souza, Jr. ..... E04F 11/1812 256/22
5,400,555 A * 3/1995 Kantor ..... E04H 4/0043 256/24
5,761,875 A * 6/1998 Oliphant ..... E04B 1/4121 248/218.4
6,843,453 B1 * 1/2005 Rogers ..... B65B 67/1205 248/99
7,594,582 B2 * 9/2009 Sus ..... A47J 27/18 220/9.4
7,919,002 B1 * 4/2011 Hurtado ..... E04D 13/08 210/747.2
8,789,801 B2 * 7/2014 Newman ..... B62B 1/24 248/133

(Continued)

*Primary Examiner* — Phi D A
(74) *Attorney, Agent, or Firm* — Whitaker Chalk Swindle & Schwartz PLLC; Enrique Sanchez, Jr.

(57) ABSTRACT

The present disclosure is a method and apparatus for protecting building-related elements from collision damages. The apparatus can be designed to withstand high-impact collisions such as those caused by errant operation of heavy equipment. The method and apparatus are intended to be applicable to buildings already constructed and do not have to be implemented or considered before or during building design. In one exemplary embodiment, the apparatus can protect downspouts of warehouse sprinkler systems from collision damage that could result in pipe eruption.

12 Claims, 6 Drawing Sheets

(56) References Cited

U.S. PATENT DOCUMENTS

| | | | | |
|---|---|---|---|---|
| 8,845,151 | B1 * | 9/2014 | Hale | F21V 33/008 362/431 |
| 10,435,240 | B1 * | 10/2019 | Stroop | B65F 1/1415 |
| 2001/0002690 | A1 * | 6/2001 | Rosky | B65B 67/1227 248/99 |
| 2005/0151033 | A1 * | 7/2005 | Folkmar | A47J 47/16 248/95 |
| 2009/0300996 | A1 * | 12/2009 | Jones | E04C 3/30 52/40 |
| 2010/0215355 | A1 * | 8/2010 | Olien | F16M 11/10 396/428 |
| 2011/0239547 | A1 * | 10/2011 | Port | E04D 13/064 52/16 |
| 2012/0001036 | A1 * | 1/2012 | Santiago | B65F 1/1468 248/101 |
| 2014/0054942 | A1 * | 2/2014 | Emrich | A47C 9/10 297/334 |
| 2016/0265276 | A1 * | 9/2016 | Hartman | E06C 7/48 |

* cited by examiner

METHOD AND APPARATUS FOR PROTECTING BUILDING-RELATED ELEMENTS FROM COLLISION DAMAGES

BACKGROUND

1. Field of the Disclosure

The present disclosure relates to a method and apparatus for protecting building infrastructure, fixtures, and features located on or within structures.

2. Background of the Disclosure

In any given residential or commercial structure, several features are incorporated at a reasonable height to be accessible by the building occupants, such as plumbing components, electrical systems, or fixtures. Multiple safety features may be integrated into the building framework or otherwise fixed on or within the building after construction. The features may be required by governmental codes or contracts and generally are intended to help protect the well-being of occupants or materials located within the buildings in the case of an emergency. Some well-known examples of these safety features include fire alarms, gas detectors, defibrillators, fire axes, fire hoses, fire extinguishers, and sprinkler systems. In commercial and industrial buildings such as warehouses, sprinkler systems are just one example of a fire safety measures that can be mandatory per relevant local, state, or federal codes and ordinances.

While there are multiple types of sprinkler systems for commercial and industrial buildings, of particular note is the Early Suppression Fast Response system (ESFR). Unlike earlier counterparts, such as control mode systems, ESFR systems are designed to extinguish fires as opposed to simply controlling them. The systems are able to discharge larger volumes of water at faster rates as compared to other types of sprinkler systems. Like most well-known sprinkler systems, ESFR and other industrial systems have heads that protrude from piping that permeates the building and are capable of spreading water over large areas. Heads are generally located near the top of the building or on the ceiling to ensure efficient covering of a potential fire with pressurized water. Other components of these systems, however, need to be located closer to the floor, can be mere inches off of the ground, to be easily accessible by building personnel or fire departments. For example, fire department connections (FDCs) can be incorporated into sprinkler systems to allow a fireman crew to connect to the system and subsequently boost the pressure of the system via a pump to facilitate the extinguishing of the fire. FDCs must be at a height such that the crew can reach and utilize the FDC. Other examples of such components include alarm valves, gate valves, main drain connections, and fire department connections. To accommodate components like these, sprinkler systems incorporate pipe sections often referred to as "downspouts" that supply water pressure at lower levels of the building. As their name suggests, downspouts extend downwards from the main overhead piping complex, generally following a structural component of the building. Particularly in storage warehouses where the large square footage requires dissemination of beams throughout the structure, a downspout will buttress a beam in one or multiple locations within the warehouse.

Because downspouts are located in the building such that they are accessible by relevant personnel, they are also more exposed and prone to be damaged accidently during the ordinary course of business, a concern pertinent to all of the building safety features discussed above. Commercial and industrial buildings can have heavy equipment such as forklifts operating within the walls, and errant operation of such equipment can lead to accidental damaging of these components. This is of particular concern with a feature such as an ESFR system because damaging of an accessible component (e.g. an FDC) or a downspout could lead to massive flooding and countless dollars in damages to the structure and materials housed within, not to mention the obvious safety concerns surrounding such flooding. Damages to other safety features (i.e. fire extinguishers, defibrillators, or axes/hoses encased in glass) pose similar issues that are equally concerning: fire extinguishers could rupture, defibrillators could expose energized wires, and broken glass cases could pose hazards for building personnel.

SUMMARY

In one embodiment, the present disclosure provides a method and apparatus to protect building-related elements from high-impact collisions while still enabling personnel to access the element that the apparatus or method is protecting. The present disclosure is intended to protect building-related elements from collisions, such as from heavy equipment, that could injure or damage the element.

In one embodiment, the present disclosure comprises an apparatus configured to protect building-related elements from collision damages. The apparatus comprises a first bumper member comprising an anterior portion and a posterior portion, the first bumper member defining a cavity; and a frame rail connected to the posterior portion of the bumper member. The frame rail can be configured to be coupled to a surface and the bumper can configured to deflect impact forces around a portion of the cavity.

In another embodiment, the present disclosure comprises a method of protecting building-related elements from collision damages, comprising the steps of providing a protection apparatus, and installing the protection apparatus on a surface. The protection apparatus comprises a first bumper member comprising an anterior portion and a posterior portion, the first bumper defining a cavity; and a frame rail connected to the posterior portion of the bumper member and configured to be coupled to a surface. The bumper can be configured to deflect impact forces around a portion of the cavity. This deflection of impact forces can eliminate or mitigate damage to a building element disposed within the bumper cavity.

In another embodiment, the present disclosure comprises an apparatus configured to protect building-related elements from collision damage, comprising: a first guard bar lumen having a linear side, a curved side, a first arm member, and a second arm member, the first and second arm members extending from the linear side at a first angle between the linear side and the first arm member and a second angle between the linear side and the second arm member; a second guard bar lumen having a linear side, a curved side, a first arm member, and a second arm member, the first and second arm members extending from the linear side at a first angle between the linear side and the first arm member and a second angle between the linear side and the second arm member; and a first angle iron having a first portion coupled at the first angle to a second portion, a second angle iron having a first portion coupled at the second angle to a second portion. The first angle iron can be coupled to the first and second guard bar lumens along at least a portion of the first angle of the first and second guard bar lumens, and the second angle iron can be coupled to the first and second guard bar lumens along at least a portion of the second angle of the first and second guard bar lumens.

DETAILED DESCRIPTION

The present disclosure describes advantages over the art by providing a method and apparatus for protecting building-related elements from collision damages while simultaneously allowing for facile access to the protected elements. In one exemplary embodiment, a protection apparatus can protect against high-impact collision damages, such as from heavy equipment operation. In another exemplary embodiment, the protection apparatus can be installed in a building after construction (retrofitted) and affixed around a building-related element.

Figure 1:
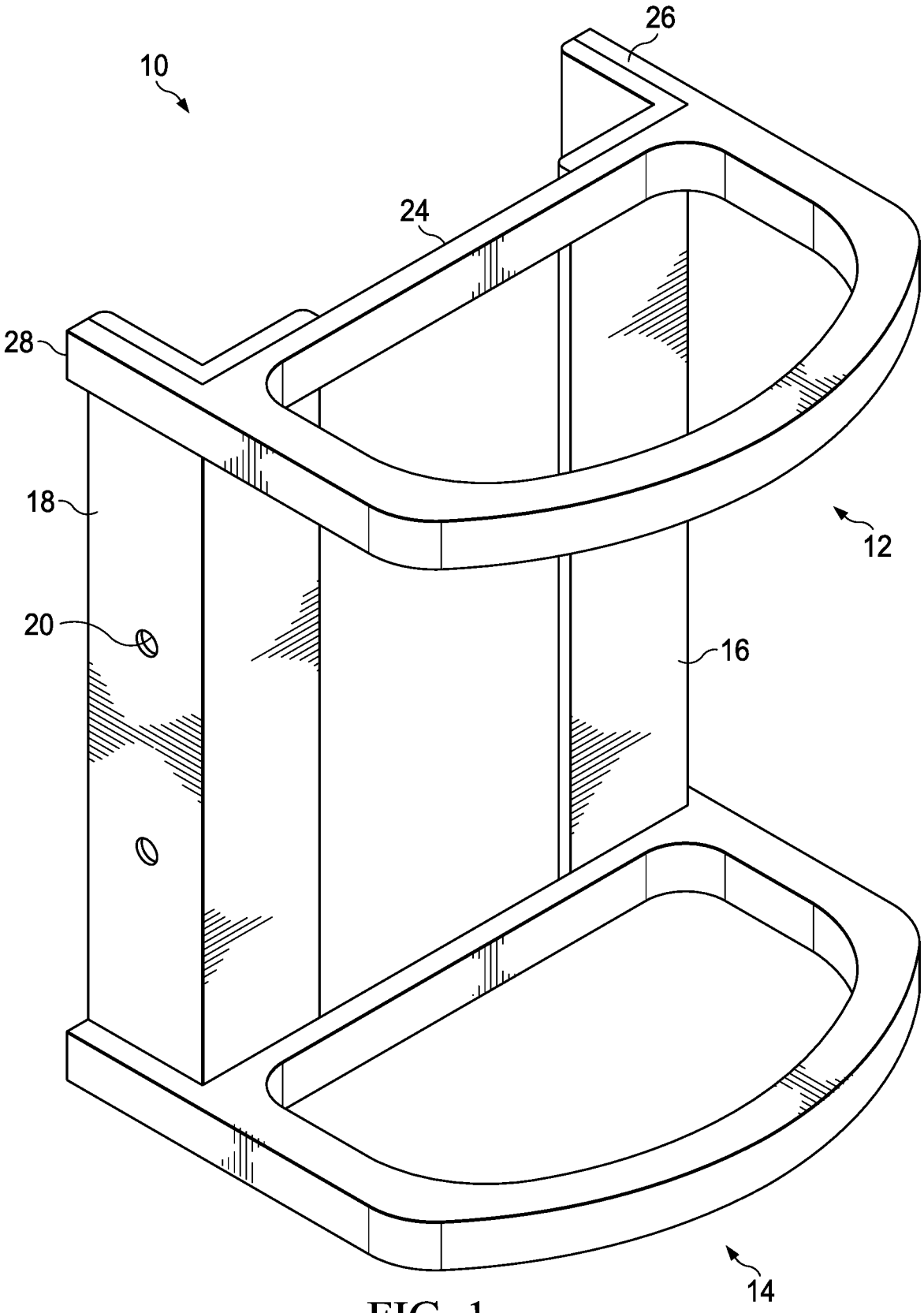
FIG. 1 shows a perspective view of an apparatus for protecting building-related elements, in accordance with an exemplary embodiment of the present disclosure.

FIG. 1 shows a protection apparatus 10 including a first bumper member (guard bar lumen) 12 and a second bumper member (guard bar lumen) 14, in accordance with an exemplary embodiment of the present disclosure. The first bumper member 12 and the second bumper member 14 can have an anterior portion and a posterior portion. The anterior portion is preferably curved, but can be linear, tapered, sawtooth, segmented, concave, convex, or other suitable configuration. The posterior portion is preferably linear, but can be curved, tapered, sawtooth, segmented, concave, convex, or other suitable configuration. In another exemplary embodiment, the posterior portion can be shaped to conform to the contours of a building element. Additionally, the bumper members 12, 14 are preferably a unitary body, but the bumper members can alternatively be comprised of multiple components securably coupled. Although two bumper members 12, 14 are shown in the exemplary embodiment of FIG. 1, a single bumper member, or a more that two bumper members may be incorporated in the protection apparatus 10. The number of bumper members incorporated in to the protection apparatus 10 can be determined by the size of the building element to be protected, the location of the building element to be protected, or the expected force that can be exerted on the bumper members, among other relevant considerations.

The bumper members 12, 14 can additionally have arms 26, 28 that outwardly extend from the posterior portion 24. The bumper members 12, 14 can be coupled to two frame rails 16, 18 that lend structural support to the apparatus 10 and facilitate coupling of the apparatus 10 to a surface. The bumper members 12, 14 can be coupled to the two frame rails 16, 18, via a weld, rivet, screw, nut, bolt, or other suitable attachment mechanism. The bumper member 12, 14 can be coupled to the frame rails 16, 18 via both the posterior portions and the arms 26, 28. The frame rails 16, 18 can be angel irons configured to couple to two parallel edges of a column; however, the frame rails 16, 18 could take the form of any structural element or suitable component capable of lending structural support to the apparatus 10 and facilitating coupling of the apparatus 10 to a surface. For example, a frame rail can take the form of an angle iron, a rail, a bar, a strip, a sheet, a ring, a pole, or other suitable component. In one exemplary embodiment, the frame rails 16, 18 can be angle irons having holes 20 configured to receive a bolt that threads through a column and causes the angle irons to engage the column edges when tightened.

The bumper members 12, 14, arms 26, 28, are preferably made of standard ASTM A36, hot-rolled steel plate (1" thick on the arms) and (⅜" thick on the angles). Alternatively, grade 50 steel can be used.

Figure 2A:
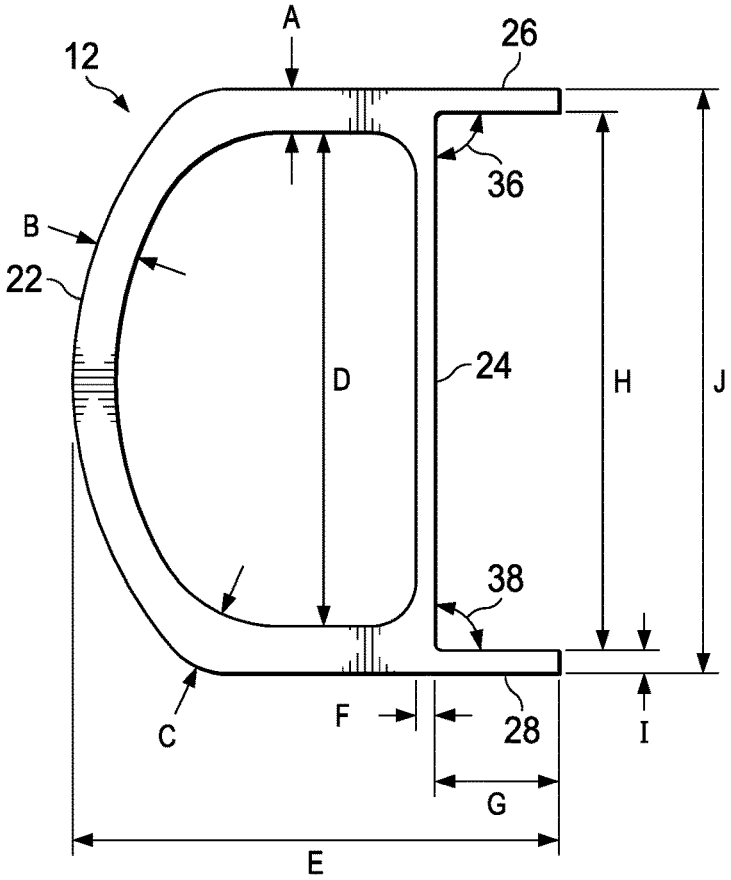
FIG. 2A shows a top view of the bumper member (guard bar lumen), in accordance with an exemplary embodiment of the present disclosure.

FIG. 2A depicts a top view of the bumper member with notations at areas of preferred measurements, in accordance with an exemplary embodiment of the present disclosure. In one exemplary embodiment, dimension A can be 1.03 inches, B can be 1 inch, C can be 1.5 inches, D can be 11.81 inches, E can be 11.63 inches, F can be 0.5 inches, G can be 3 inches, H can be 12.94 inches, I can be 0.5 inches, and J can be 13.94 inches. Importantly each of the dimensions A, B, C, D, E, F, G, H, I, and J can be varied to suit a particular application. Application considerations can include the flexibility of the metal. FIG. 2A also shows a first angle 36 between the first arm 26 and the linear side 24 and a second angle 38 between the second arm 28 and linear side 24. The first angle 36 and the second angle 38 are preferably 90°, but can be acute, obtuse, or other suitable angle. Additionally, the first angle 36 and the second angle 38 can have a curvature at the origin point of 0.05" or other suitable radius.

Figure 2B:
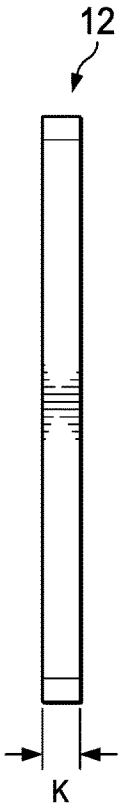
FIG. 2B shows a front view of the bumper member (guard bar lumen), in accordance with an exemplary embodiment of the present disclosure.

FIG. 2B shows a front view of the bumper member 12, in accordance with one exemplary embodiment. The bumper member 12 has a width K. The width K is preferably 1 inch, but the width can be varied based on the expected forces the bumper member 12 is expected to encounter. Increasing the width for greater expected forces and decreasing the width for lesser expected forces. In another exemplary embodiment, the frame rails 16, 18 can be sixteen inches in length, but the length of the frame rails 16, 18 can be varied based on the distance between bumper members, length of a building element, or other suitable consideration.

Figure 2C:
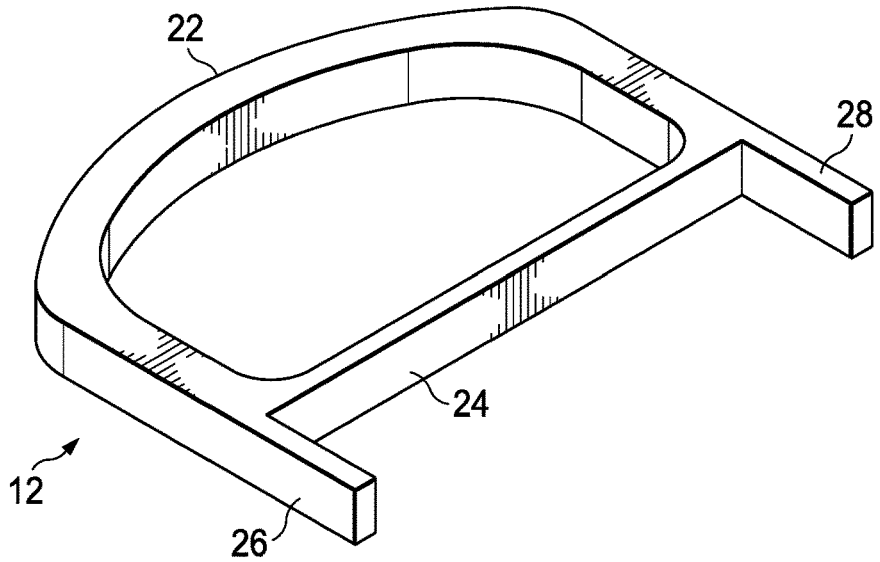
FIG. 2C shows a perspective view of the bumper member (guard bar lumen), in accordance with an exemplary embodiment of the present disclosure.

FIG. 2C shows a perspective view of the bumper member 12, comprising an anterior portion 22, posterior portion 24, and arm members 26, 28. In this embodiment, the bumper member 12 is shown as a D-shaped arch, but the bumper member 12 can be of other shapes, including, but not limited to ovals, rectangles, semicircles, triangles, or any other suitable shape with a cavity that is capable of deflecting impact forces away from a surface or a building element disposed within the cavity. The anterior portion 22 of the bumper member 12 can be thickest at the "corners" of the arch beginning at the spring line and tapered towards the middle of the anterior portion 22 and towards the sides of the anterior portion 22, such that the bumpers can be thickest at the junctions of the sides of the anterior portion 22 and middle of the anterior portion 22. This design can enable the bumper member 12 and attached apparatus 10 to better withstand collision forces. The arm members 26, 28 can be of any suitable length to allow its coupling to a building structure, such as a column, wall, or other suitable component. In other embodiments, bumper member 12 does not have arm members 26, 28, such that the bumper member 12 can be disposed directly on a building structure. In such embodiments, the posterior portion 24 can have one or more holes for receiving a securing mechanism and the frame rails 16, 18 can be flat elements.

Figure 3A:
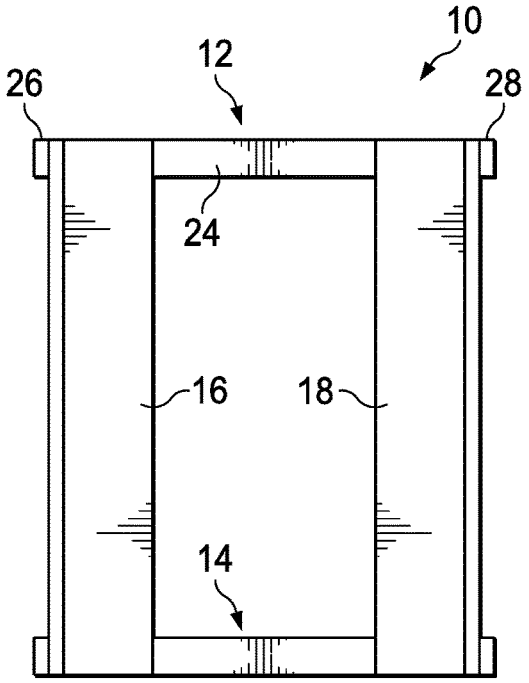
FIG. 3A shows a rear view of the protection apparatus, in accordance with an exemplary embodiment of the present disclosure.

FIG. 3A depicts the apparatus 10 as viewed from the rear, according to one exemplary embodiment, with the frame rails 16, 18 coupled to the first and second guard bar lumens 12, 14 at the first angle 36 (not shown) and second angle 38 (not shown), respectively.

Figure 3B:
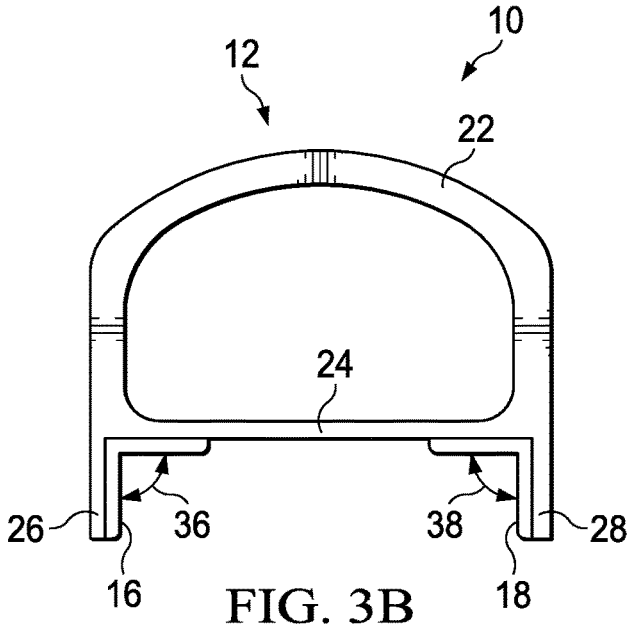
FIG. 3B shows a top view of the protection apparatus, in accordance with an exemplary embodiment of the present disclosure.
Figure 3C:
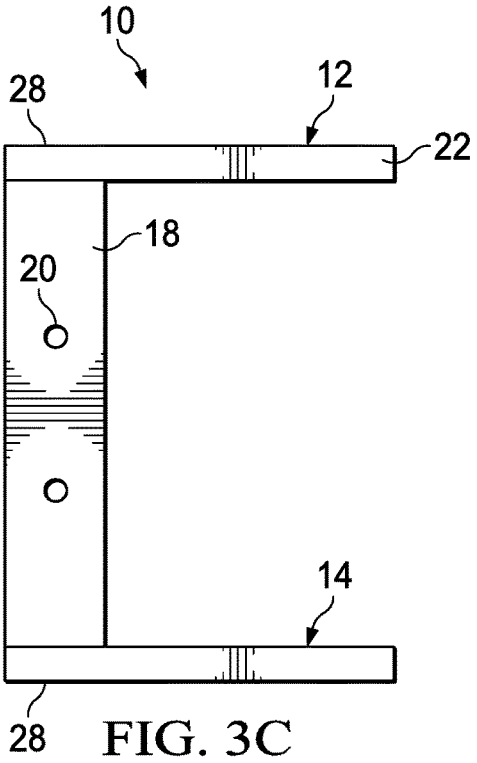
FIG. 3C shows a side view of the protection apparatus, in accordance with an exemplary embodiment of the present disclosure.

FIG. 3B shows a top view of the device, in accordance with one exemplary embodiment of the present disclosure, wherein the guard bar lumen 12 can coupled to the angle irons at the first and second angles 36, 38. FIG. 3C depicts a side view of the apparatus 10. The guard bar lumen 12 can coupled to the angle irons 16, 18, via a weld, rivet, screw, nut, bolt, or other suitable attachment mechanism.

Figure 4A:
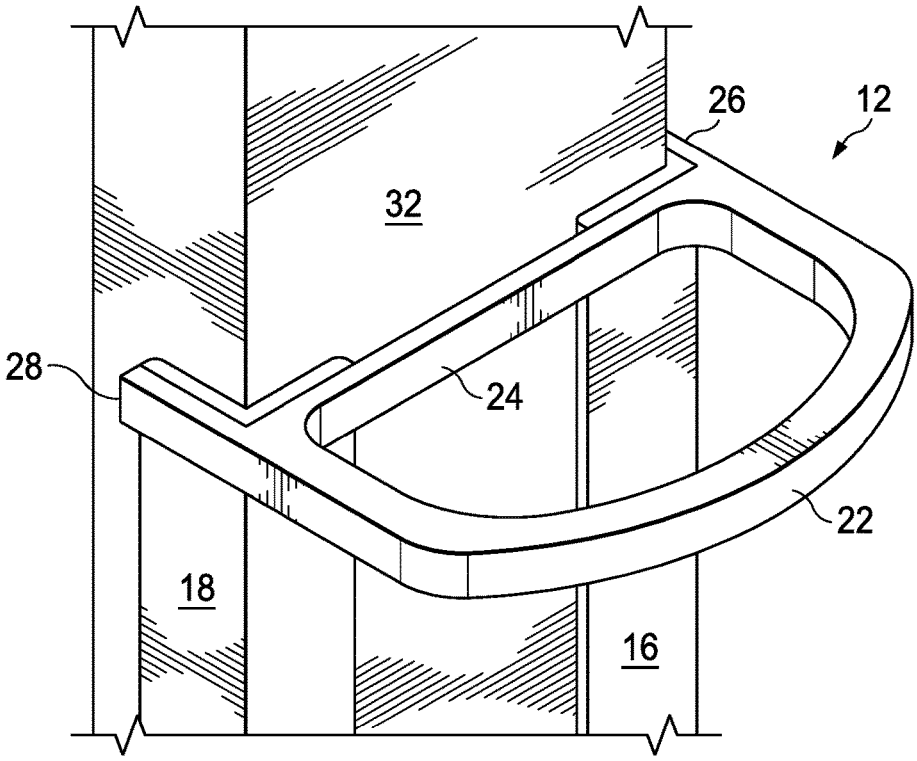
FIG. 4A shows a partial perspective view of the upper portion of the protection apparatus disposed on a column, in accordance with an exemplary embodiment of the present disclosure.
Figure 4B:
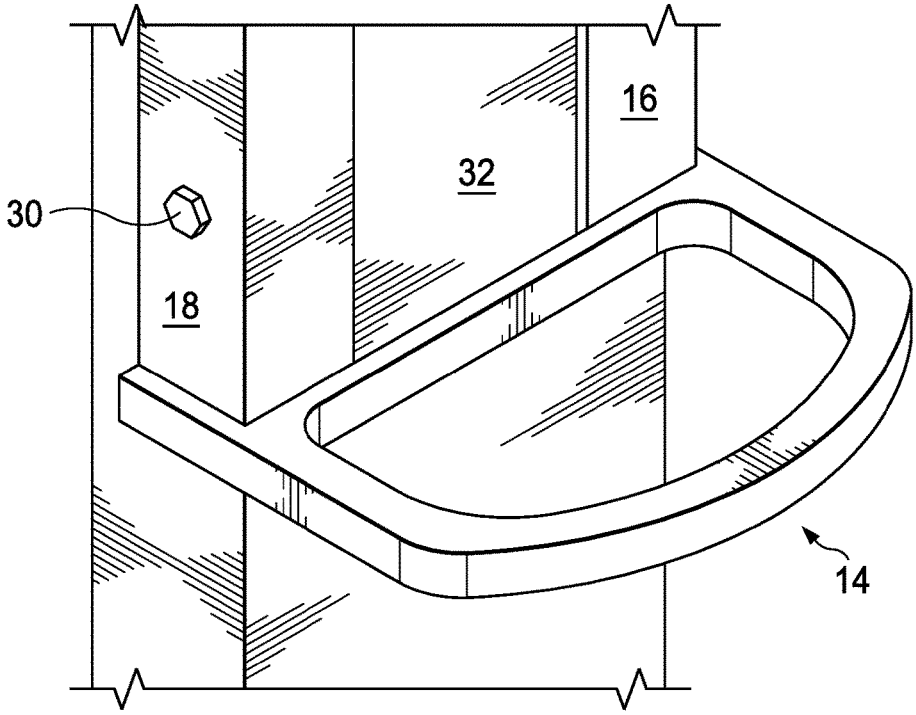
FIG. 4B shows a partial perspective view of the lower portion of the protection apparatus disposed on a column, in accordance with an exemplary embodiment of the present disclosure.

FIGS. 4A and 4B show an exemplary embodiment of the present disclosure. Preferably, the apparatus 10 can be installed on a building structure or surface 32, here depicted as a column. The frame rails 16, 18 can be angle irons configured to couple to the column via the bolt 30 threaded through the column and the holes 20 on the frame rails 16, 18. The apparatus can be installed such that the posterior portion 24 of the bumper member 12 is adjacent the surface 32, and the anterior portion 22 of the bumper member 12 protrudes outwards from the surface 32. The bumper members 12, 14 can be configured to deflect impact forces away from the surface.

Figure 5:
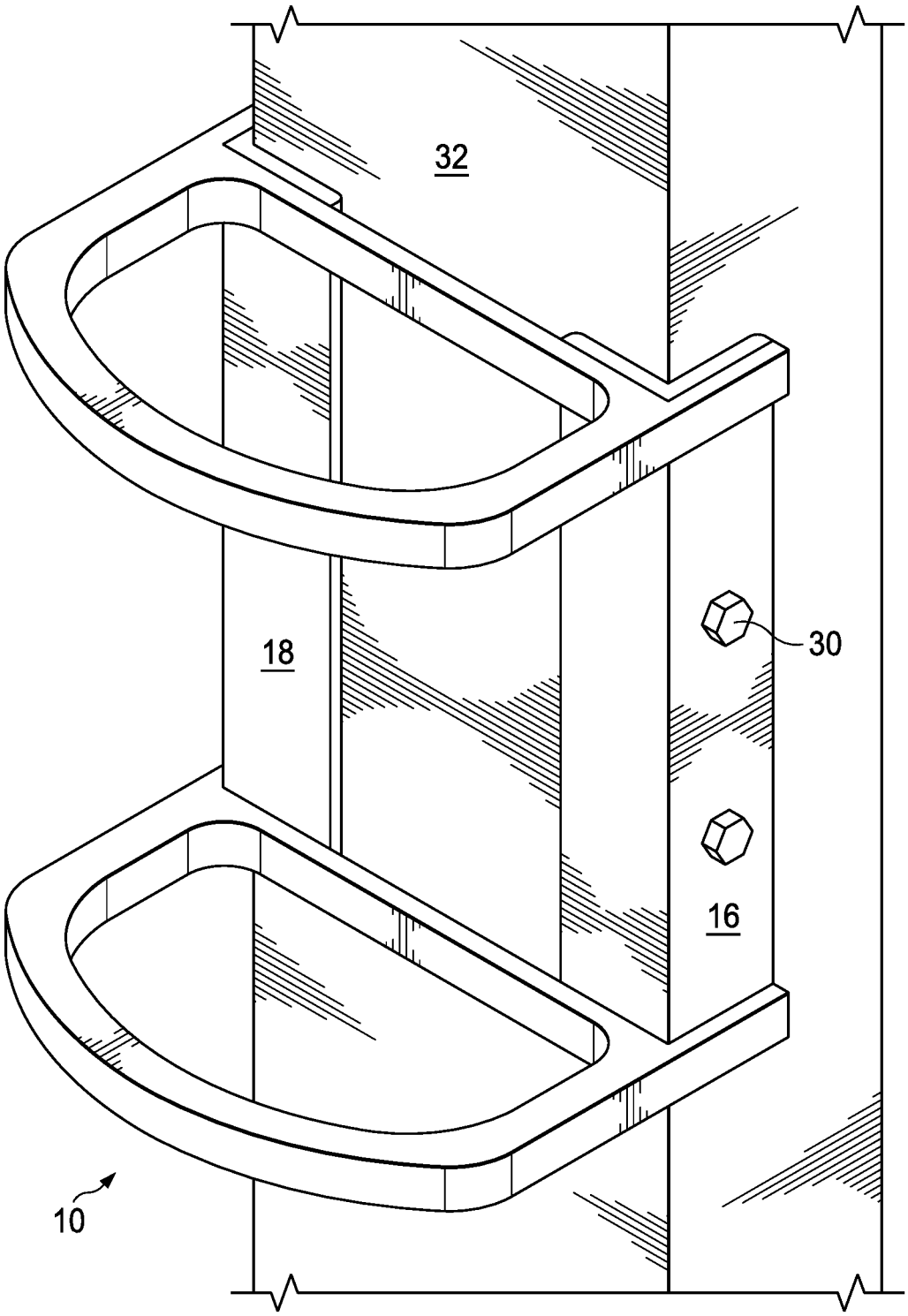
FIG. 5 shows a perspective view of the apparatus disposed on a column, in accordance with an exemplary embodiment of the present disclosure.
Figure 6:
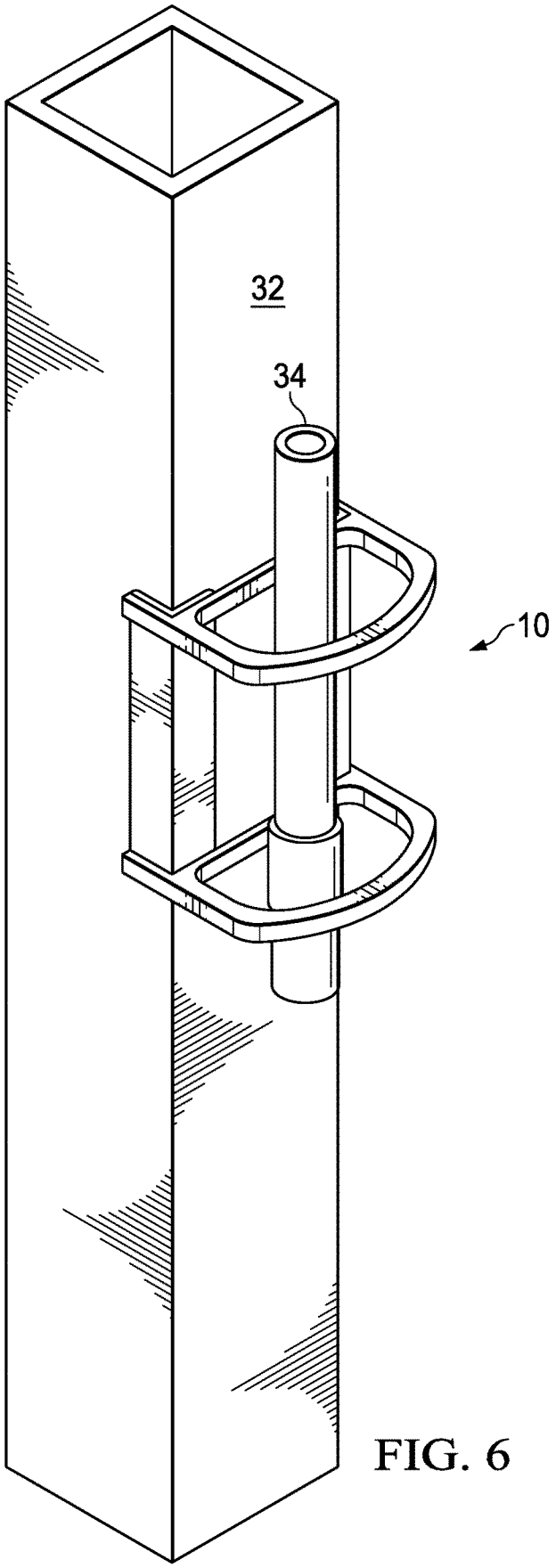
FIG. 6 shows a perspective view of the apparatus disposed on a column with a building-related element disposed therethrough, in accordance with an exemplary embodiment of the present disclosure.

FIG. 5 depicts an exemplary embodiment of the present disclosure, wherein the apparatus 10 can preferably be installed on a column, wherein the bolts 30 can be threaded through the column and secured to both frame rails, such that tightening of the bolts 30 causes the frame rails 16, 18 to squeeze and grip the column. FIG. 6 depicts another embodiment of the apparatus 10 in use. Preferably, the apparatus 10 can be installed on a surface 32, such that a building-related element 34, shown here as a downspout, is within the cavity of a bumper member or guard bar lumen such that the element 34 is protected from impact forces. In this particular embodiment, the apparatus 10 can be intended to prevent an object (for example, a forklift) applying up to 250,000 N of force to the bumper members from reaching the downspout 34. For example, if 250,000 N of force were applied to a bumper member 12, 14, the apparatus 10 could maintain its structural integrity, such that no portion of the apparatus 10, the bumper member 12, 14, or the object applying the force could contact the downspout 34. In one embodiment, and as an example, the apparatus 10 can prevent an object weighing 9,000 lbs (mass of 4090.9 kg), traveling at a speed of 10.5 mph, from reaching a building element. In this example, the apparatus can decelerate the object at $-57.22\ m/s^2$, meaning that the apparatus can have a stopping force of up to 234,086.2573 N, with a displacement of the bumper member 12, 14 due to the collision having a value of less than 1 inch.

The present disclosure provides at least the following advantages over prior art:

1) protection of building-related elements from high-impact collision damages, such as from heavy equipment;

2) facile access to said elements while the elements are protected; and 3) ability to protect elements after the building is already constructed.

Persons skilled in the art will readily understand that these advantages (as well as the advantages indicated in the summary) and objectives of this system would not be possible without the particular combination of structural components and mechanisms assembled in this inventive apparatus and described herein.

The disclosure can be embodied in other specific forms without departing from the spirit or essential characteristics thereof. For example, each of the new structures described herein, can be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions are established by the appended claims rather than by the foregoing description. All changes that come within the meaning and range of equivalency of the claims are therefore intended to be embraced therein. Further, the individual elements of the claims are not well-understood, routine, or conventional. Instead, the claims are directed to the unconventional inventive concept described in the specification.

Where reference if made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Terms that traditionally infer a sequential order, such as "first" or "second" or "third", are used to distinguish one element from another element and are not necessarily meant to denote that an element is the primary or initial element in any given sequence of elements. For example, "a first wire" does not necessarily signify that the wire is the first in a sequence of wires or the first wire to be changed or modified by a method or apparatus. Instead, "a first wire" can only indicate that the wire is separate and distinguishable from another wire, such as "a second wire" or "a third wire."

The disclosure presented in the written description and the various features and advantageous details thereof are explained more fully with reference to the non-limiting examples included and as detailed in the description which follows. Descriptions of well-known components and processes and manufacturing techniques are omitted so as to not unnecessarily obscure the principal features of the disclosure as described herein. The examples used in the description which follows are intended merely to facilitate an understanding of ways in which the disclosure can be practiced and to further enable those skilled in the art to practice the disclosure. Accordingly, the examples should not be construed as limiting the scope of the disclosure.

What is claimed is:

1. An apparatus configured to protect building-related elements from collision damages, comprising:

a first bumper member comprising an anterior portion and a posterior portion, the first bumper defining a cavity; and a first frame rail and second frame rail connected to the posterior portion of the bumper member, wherein the frame rail is configured to be coupled to a surface and the bumper member is configured to deflect impact forces around a portion of the cavity and away from a building-related element disposed within the cavity wherein the first and second frame rails includes an angle iron configured to be coupled to the surface, wherein the surface is a column, and wherein the first and second frame rails are configured to be coupled to parallel edges of the column.

2. The apparatus of claim 1, further comprising a second bumper member comprising an anterior portion and a posterior portion, together defining a cavity, wherein the frame rale is connected to the posterior portion of each of the first and second bumper members.

3. The apparatus of claim 1, wherein the first bumper member further comprises an arm member.

4. The apparatus of claim 3, wherein the frame rail is connected to the arm member.

5. The apparatus of claim 1, wherein the anterior portion of the first bumper member is an arch.

6. The apparatus of claim 1, wherein the apparatus is configured to prevent an object from reaching the surface when the impact force is received on at least a portion of the first bumper member.

7. A method of protecting building-related elements from collision damages, comprising the steps of:

providing a protection apparatus comprising:

a first bumper member comprising an anterior portion and a posterior portion, the first bumper defining a cavity; and a frame rail coupled to the posterior portion of the bumper member and configured to be coupled to a surface; and installing the protection apparatus on the surface, wherein the first bumper is configured to deflect impact forces around a portion of the cavity and away from a building-related element disposed within the cavity.

8. The method of claim 7, wherein the protection apparatus further comprises a second bumper member comprising an anterior portion and a posterior portion, together defining a cavity, wherein the frame rale is connected to the posterior portion of each of the first and second bumper members.

9. The method of claim 7, wherein the apparatus is configured to prevent an object from reaching the surface when the impact force is received on at least a portion of the first bumper member.

10. An apparatus configured to protect building-related elements from collision damage, comprising:

a first guard bar lumen having a linear side, a curved side, a first arm member, and a second arm member, the first and second arm members extending from the linear side at a first angle between the linear side and the first arm member and a second angle between the linear side and the second arm member;

a second guard bar lumen having a linear side, a curved side, a first arm member, and a second arm member, the first and second arm members extending from the linear side at a first angle between the linear side and the first arm member and a second angle between the linear side and the second arm member;

a first angle iron having a first portion coupled at the first angle to a second portion; and a second angle iron having a first portion coupled at the second angle to a second portion, wherein the first angle iron is coupled to the first and second guard bar lumens along at least a portion of the first angle of the first and second guard bar lumens, and the second angle iron is coupled to the first and second guard bar lumens along at least a portion of the second angle of the first and second guard bar lumens, wherein the first guard bar is configured to deflect impact forces away from a building-related element disposed within the cavity.

11. The apparatus of claim 10, wherein the first portion of the first angle iron is coupled to the linear side of the first guard bar lumen and the second portion of the first angle iron is coupled to the first arm member of the first guard bar lumen, and the first portion of the second angle iron is coupled to the linear side of the first guard bar lumen and the second portion of the second angle iron is coupled to the second arm member of the first guard bar lumen.

12. The apparatus of claim 11, wherein the first portion of the first angle iron is coupled to the linear side of the second guard bar lumen and the second portion of the first angle iron is coupled to the first arm member of the second guard bar lumen, and the first portion of the second angle iron is coupled to the linear side of the second guard bar lumen and the second portion of the second angle iron is coupled to the second arm member of the second guard bar lumen.

* * * * *